US005780817A

United States Patent [19]

Eckman et al.

[11] Patent Number: 5,780,817

[45] Date of Patent: Jul. 14, 1998

[54] RETROFITTABLE GLASS-TOP ELECTRIC STOVE ELEMENT

[76] Inventors: Hanford L. Eckman, 401 Millington Rd., Shavertown, Pa. 18708; Charles M. Eckman, 11 Rice Dr., Dallas, Pa. 18612

[21] Appl. No.: 608,066

[22] Filed: Feb. 27, 1996

[51] Int. Cl.[6] ..... H05B 3/68

[52] U.S. Cl. ..... 219/458; 219/451; 219/463; 219/467

[58] Field of Search ..... 219/458, 461, 219/463, 465, 466, 467, 468, 451

[56] References Cited

U.S. PATENT DOCUMENTS

| | | | |
|---|---|---|---|
| 2,428,899 | 10/1947 | Wiegand | 219/468 |
| 3,686,477 | 8/1972 | Dills et al. | 219/462 |
| 3,749,883 | 7/1973 | Vodvarka et al. | 219/463 |
| 3,987,275 | 10/1976 | Hurko | 219/461 |
| 4,021,642 | 5/1977 | Fields, Jr. | 219/391 |
| 4,083,355 | 4/1978 | Schwank | 126/39 J |
| 4,094,297 | 6/1978 | Ballentine | 126/39 J |
| 4,201,184 | 5/1980 | Scheidler et al. | 126/39 J |
| 4,296,311 | 10/1981 | Hagglund et al. | 219/464 |
| 4,615,987 | 10/1986 | Chyung et al. | 501/8 |
| 4,933,401 | 6/1990 | Diekmann et al. | 126/39 E |
| 5,397,873 | 3/1995 | Stoops et al. | 219/450 |

OTHER PUBLICATIONS

Trade Literature entitled "Euro–Burner Solid Disc Conversion Burners", Energy Convertors, Inc., Dallas, Pennsylvania, 1991.

*Primary Examiner*—Teresa J. Walberg
*Assistant Examiner*—Sam Paik
*Attorney, Agent, or Firm*—Duane, Morris & Heckscher

[57] ABSTRACT

Electrical resistance retrofittable stove heating elements are provided which include a metal oxide-containing cooking top and a sheathed resistance heating element spaced from the lower surface of the cooking top. The stove element can also contain a housing bowl disposed below the sheathed resistance heating element for helping to reflect radiant heat from the heating element to the cooking top. The sheathed resistance heating element also includes a pair of plug-in terminals for selectively connecting said retrofittable stove element to a source of electric power. These stove elements can be used in original equipment or in older stoves having conventional electric stove elements.

17 Claims, 2 Drawing Sheets

RETROFITTABLE GLASS-TOP ELECTRIC STOVE ELEMENT

FIELD OF THE INVENTION

Figure 1:
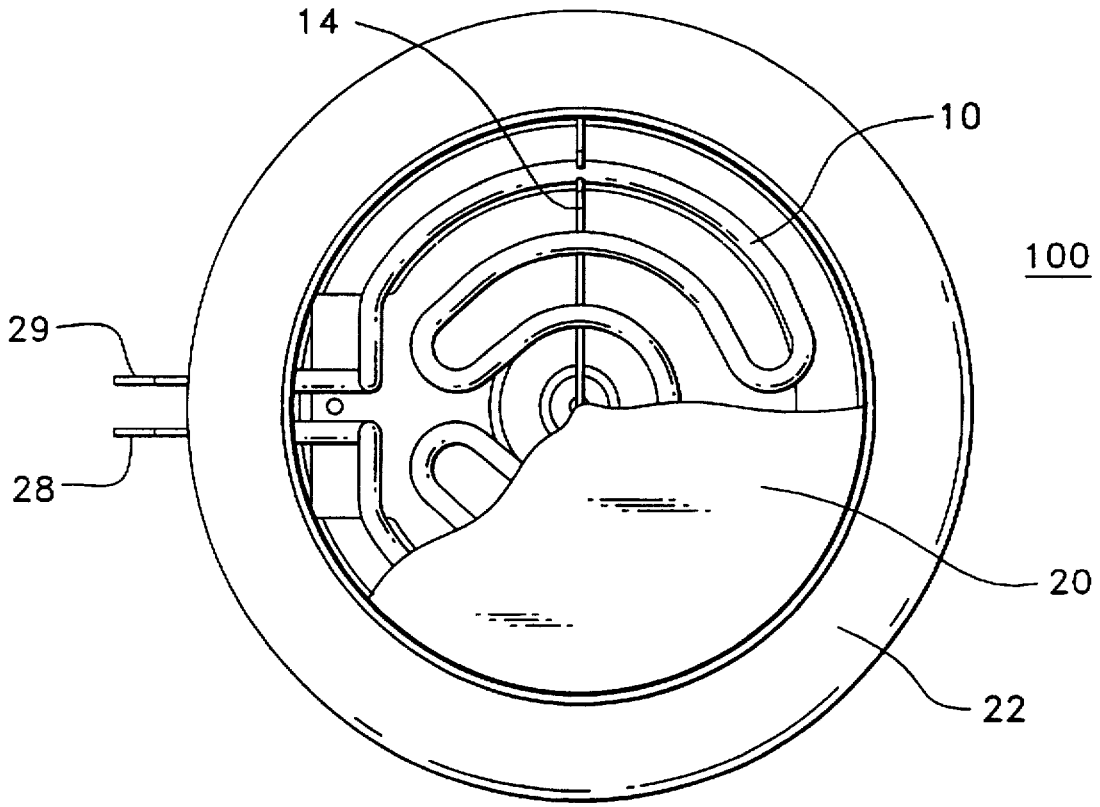

This invention relates to stove elements for electric ranges, and particularly to stove elements having a glass or ceramic cooking surface.

BACKGROUND OF THE INVENTION

For many years, metal-sheathed electric resistance heating elements have been coiled into a disk-like shape then used in electric ranges. These elements have a pair of terminal end portions which permit them to be inserted into the slots of a terminal block so that they can be removed for cleaning and replacement. Consumers have grown accustomed to the "retrofittable" nature of these elements, since it is almost as easy to change a burnt-out element as it is to change a light bulb.

More recently, the industry has been gravitating toward stove tops made of glass. While early glass plates included a sheathed resistance wire heater abutting the glass top cooking surface (U.S. Pat. No. 3,987,275, incorporated herein by reference), more recent designs have employed bare resistance wire beneath the glass surface for providing more efficient radiant heat (U.S. Pat. No. 4,296,311 which is also incorporated by reference). Bare resistance wire has been preferred by manufacturers since it is believed to be more competitive with gas stoves as to the rate of heat production from ambient temperature. Radiant heat cooking, as opposed to conductive heating, is often highly desirable because it does not involve a substantial loss of thermal energy to refractory insulators or fibrous pads supporting or surrounding the resistance element.

Unfortunately, glass tops are known to break when exposed to impact forces, for example, when a pot full of water is dropped onto the glass surface. If an open resistance wire is employed to produce radiant heat, and the glass cooking top is shattered, the result is a dead short. Additionally, current glass top cooking surfaces that are made for original equipment installation do not typically provide for simple retrofitting of burnt-out heating elements. This is not surprising, since the arrangement of open resistance wires suspended below the cooking surface would be difficult and costly to reproduce in a replacement element for consumer installation.

Accordingly, there is a need for an electrical resistance stove element which can be easily replaced by homeowners, but which is efficient to use and does not pose a risk of serious electric shock.

SUMMARY OF THE INVENTION

The present invention provides retrofittable stove elements which include a metal oxide containing cooking top having an upper cooking surface and a lower surface. The element includes a sheathed resistance heating element spaced from the lower surface of the cooking top. In an important aspect of this invention, the sheathed resistance heating element is provided with plug-in terminals for selectively connecting the sheathed resistance element to a source of electrical power.

The present invention can provide a glass or ceramic replacement for existing sheathed coil elements. This invention combines the retrofitting ability of sheathed coils with the attractive appearance and ease of cleaning of glass top ranges. The present invention primarily uses radiant thermal energy for heating, yet substantially reduces the risk of electrical shock since the resistance wire is sheathed and insulated. This invention represents a successful combination of glass top cooking surfaces with safe and reliable sheathed resistance heating elements.

In further embodiments of this invention, a stove is provided which contains at least one or more individually controlled electric resistance stove elements. At least one of these elements includes a metal oxide cooking top and a housing bowl disposed below it for defining a cavity into which a sheathed resistance heating element is provided. The resistance element contains a universal, plug-in terminal means for connecting the element to a source of electrical power.

A BRIEF DESCRIPTION OF THE DRAWINGS

Figure 2:
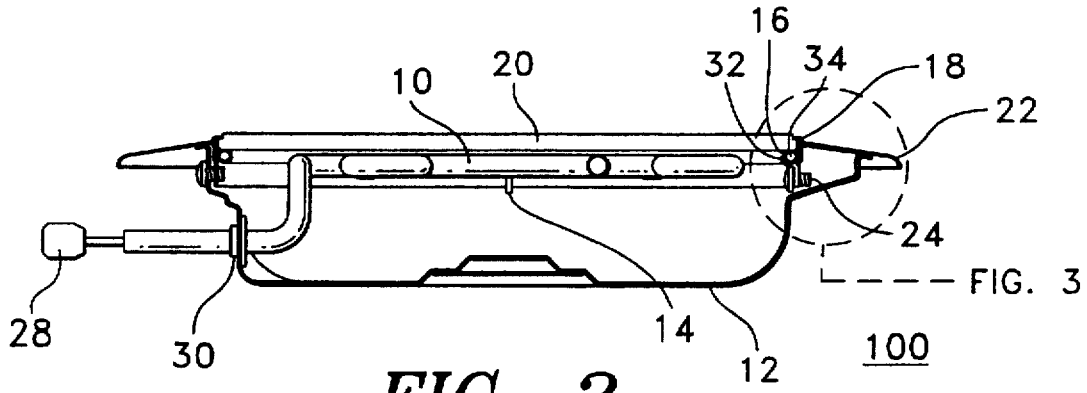
Figure 3:
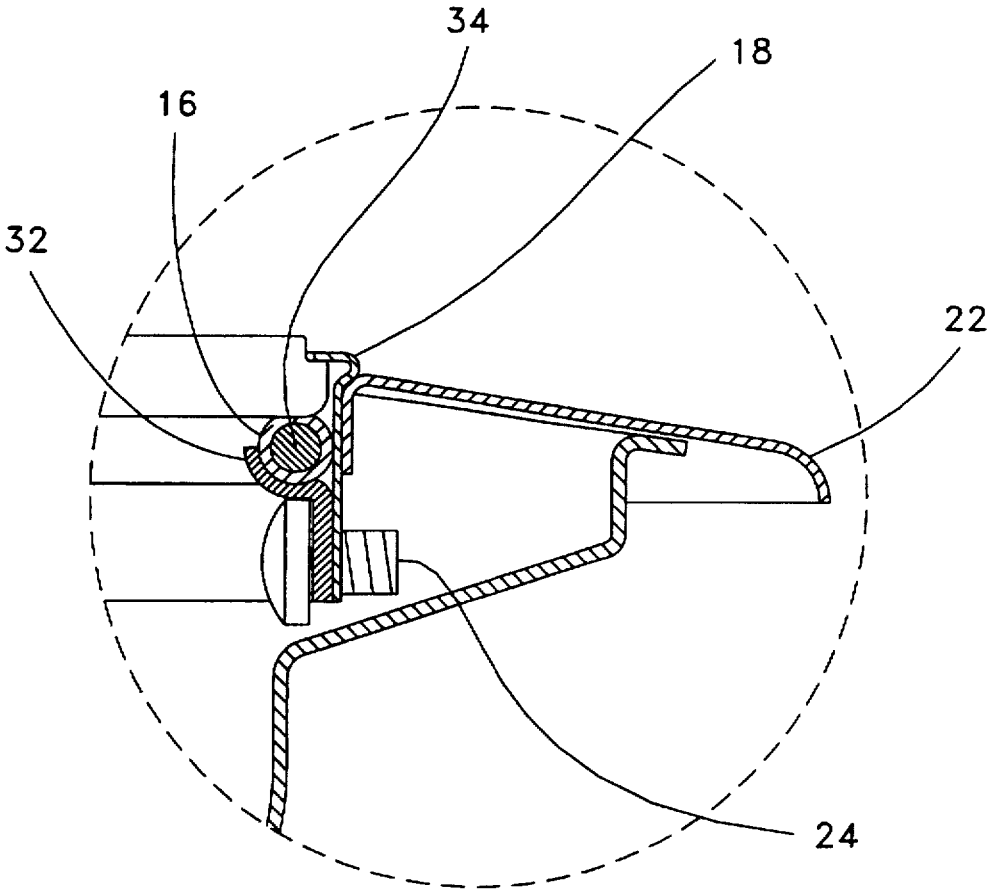
Figure 4:
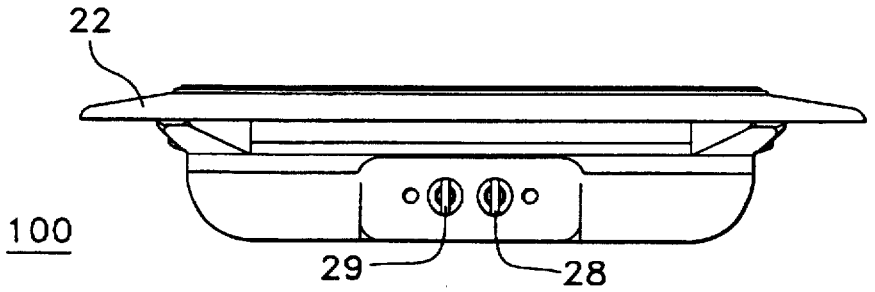

The accompanying drawings illustrate preferred embodiments of the invention according to the practical application of the principles thereof, and in which:

FIG. 1: is a top plan view of the preferred retrofittable stove element of this invention, with a partial peel-away view revealing a sheathed resistance heating element;

FIG. 2: is a cross-sectional side view of the preferred retrofittable stove element of FIG. 1;

FIG. 3: is an enlarged partial cross-sectional side view of the peripheral region of the stove element cross-section of FIG. 2; and FIG. 4: is a side plan view of the retrofittable stove element of FIG. 1.

A DETAILED DESCRIPTION OF THE INVENTION

Retrofittable stove elements are provided by this invention which include sheathed resistance heating elements and metal oxide cooking surfaces. These elements are easy to clean and significantly reduce the risk of electric shock posed by open resistance wire stove tops.

With reference to the figures, and particularly to FIGS. 1–4 thereof, there is shown a preferred retrofittable stove element 100 comprising a metal oxide cooking surface 20 which can be translucent, opaque or transparent. Beneath the cooking top 20, is located a sheathed resistance heating element 10 disposed preferably about 0.125–0.50 inches away from the lower surface of the cooking top 20. The heating element 10 is supported in spaced relation from the cooking top 20 by element support 14 which preferably has at least two semicircular indentations for retaining the heating element 10. Retainer ring 18 can be disposed entirely around the circumference of the heating element 10 and cooking top 20 and assists in carrying the trim ring 22. The trim ring 22 provides a pleasing aesthetic appearance to the cooking top 20.

The stove element 100 also can contain a housing bowl 12 which preferably contains a stamped metal bowl-shaped configuration having a reflective surface on its interior for reflecting radiant heat from the heating element 10 back to the cooking top 20. The housing bowl 12 can be made from stainless steel or chrome plated carbon or low alloy steel, for example. The housing bowl 12 has at least a pair of openings through one side thereof for permitting the terminal end portions 28 and 29 of the heating element 10 to pass through. An insulating mounting fitting 30 can be provided between the heating element 10 and the housing bowl 12 to minimize heat loss. The housing bowl 12 can be positioned to fit below the outer edge of the trim ring 22.

The metal-oxide-containing cooking top 20 of this invention preferably is made of a ceramic or glass plate material. Suitable transparent or translucent glass surfaces which are available commercially include "PYROCERAM" from Corning, "HERCUVIT" from Pittsburgh Plate Glass, "CERVIT" from Owens Ill. and "CERAN" from Schott. Thicknesses ranging from about 3–7 mm are highly desirable.

FIG. 3 also details the connection between the cooking top 20 and the remainder of the housing. A retainer ring 18 is preferably fitted into a notched edge on the cooking top 20. The retainer ring has a bulge which retains the trim ring 22 in place after it is inserted. Located between the cooking top 20 and the clip 32, is, preferably, a thermally insulating supporting ring 34. The support ring 34 can be an insulating material, such as ceramic or high temperature plastic, such as silicone or PTFE, or, a metal ring having a compressible polymer sleeve 16, for example, a steel rod inside a fiberglass tube. The polymer sleeve 16 should be able to compress when the cooking top thermally expands so as to securely retain the cooking top without breaking it. This feature will also act as a shock-absorber when a pot or pan is dropped onto the cooking top. The supporting ring 34 can be held in place between the clip 32, retainer ring 18 and cooking top 20 upon torquing the threaded fastener 24.

The preferred sheathed resistance heating element 10 of this invention contains a coiled resistance heating wire encased with a protective sheath. The wire is separated from the sheath by an insulating medium. In the preferred embodiment, this medium is packed around the resistance wire and the terminal pins are disposed within coiled or looped ends of the wire. The insulating medium can be, for example, an insulating polymer, ceramic or other material which prevents the resistance coil, or coils, from shorting out to the protective sheath. A powdered ceramic material, such as magnesium oxide, or a fused ceramic material is highly desirable. The free ends of the protective sheath are then plugged with an insulating composition, such as a silicone or epoxy. The end of the terminal pins are usually joined to a clip, herein described as terminal end portions 28 and 29. This can be accomplished by spot welding or TIG welding the clips to the exposed ends of the power terminal pins.

The sheath of the heating element 10 preferably contains a high temperature, corrosion-resistant metal. Good examples include stainless steel and nickel and its alloys. The typical corrosion-resistant sheath is made to a preferred thickness of about 0.018–0.049 inches. The preferred tubular construction can be produced by drawing, extrusion or similar metalworking techniques.

The preferred resistance wires for the heating element 10 include resistance metal coils of flat or round stock. A popular choice is Ni—Cr wire. The coil's cross-section and length are generally related to the total wattage it generates after it is energized with electricity. The resistance heating element 10 should be designed to provide sufficient radiant heating of the cooking top 20 to provide a temperature of no more than about 1,500° F., preferably within the range of about 100°–1,200 F. with a maximum sheath temperature of about 1,300° F. This is significantly less than certain prior art bare wire resistance elements. (See, for example, Hagglund et al., U.S. Pat. No. 4,296,311, which attempts to produce temperatures of about 2,350° F. to compete with gas burners). While a certain amount of speed to maximum heating temperature is sacrificed with lower temperature sheathed heating elements, the increased safety and serviceability is believed to be worth this cost.

From the foregoing, it can be realized that this invention provides improved retrofittable stove elements having a glass cooking surface. Improved embodiments of this invention employ sheathed resistance heating elements in conjunction with translucent or transparent glass or ceramic tops so as to produce an inexpensive, easily replaceable electric stove element which is exceptionally safe to use. Although various embodiments have been illustrated, this was for the purpose of describing, but not limiting the invention. Various modifications, which will become apparent to one skilled in the art, are within the scope of this invention described in the attached claims.

What is claimed is:

1. A metal-oxide-containing, retrofittable electrical resistance stove element which is capable of replacing an existing plug-in-type sheathed element in a stove top, comprising:

housing bowl means having a cavity defined therein;

a self-contained metal oxide-containing cooking top mounted to and providing a protective cover for said housing bowl said cooking top having an upper cooking surface and a lower surface;

a sheathed resistance heating element spaced from said lower surface of said cooking top; and terminal means comprising plug-in-type terminal end portions for selectively connecting said retrofittable stove element to a stove top female terminal block for supplying electric power, said plug-in-type terminal end portions designed to prevent a rotation of said retrofittable stove element in said stove top.

2. The stove element of claim 1 wherein said metal oxide-containing cooking top comprises a ceramic or a glass.

3. The stove element of claim 1 wherein said sheathed resistance heating element comprises a resistance metal wire mounted within a metal sheath and insulated therefrom by a granular metal oxide material.

4. The stove element of claim 1 wherein said sheathed resistance heating element is spaced from said metal oxide cooking top by a substantially non-thermally conducting support.

5. The stove element of claim 1 wherein said universal terminal means comprises a pair of terminal end portions which can be retrofitted into an existing stove terminal block.

6. The stove element of claim 1 wherein said metal oxide cooking top comprises a thickness of about 3–7 mm.

7. The stove element of claim 1 wherein said housing bowl means comprises a reflecting surface thereon capable of reflecting radiant heat produced by said sheathed resistance heating element of said metal oxide cooking top.

8. The stove element of claim 7 wherein said housing bowl means comprises an aperture therethrough for receiving said terminal end portions of said sheathed resistance heating element.

9. The stove element of claim 8 further comprising an element support disposed across said housing bowl means for retaining said sheathed resistance heating element in spaced relation with said metal oxide cooking top.

10. A metal-oxide-containing, electrical resistance stove element for retrofitting or original equipment stove appliance applications, comprising:

a self-contained glass-containing cooking top having an upper cooking surface and a lower surface;

a sheathed resistance heating element spaced from said lower surface of said cooking top, said sheathed resistance heating element comprising a resistance metal wire mounted within a metal sheath and insulated therefrom by a metal oxide material;

a reflective housing disposed below said sheathed resistance heating element said reflective housing and said cooking top forming a substantially enclosed cavity for containing said heating element wherein said glass-containing cooking top is mounted to said housing bowl by a compressible, non-thermally conducting support ring; and universal, terminal means comprising plus-in-type terminal end portions for connecting said sheathed resistance heating element to a source of electric power;

said stove element being capable of being plugged into an existing stove terminal block, said plug-in-type terminal end portions designed to prevent a rotation of said retrofittable stove element in said stove top.

11. The stove element of claim 10 wherein said glass-containing cooking top comprises a round shape.

12. The stove element of claim 10 wherein said reflective housing bowl comprises a stamped steel shell.

13. The stove element of claim 10 wherein said sheathed resistance heating element comprises a single continuous winding.

14. A stove comprising at least one individually controlled retrofittable, electrical resistance stove element comprising:

a glass cooking top having an upper cooking surface and a lower surface;

a sheathed resistance element spaced from said lower surface of said cooking top by at least about 0.01 inches;

housing bowl means disposed below said sheathed resistance heating element said reflective housing and said cooking top forming a substantially enclosed cavity which is separable from said stove; and universal terminal means comprising plug-in-type terminal end portions for connecting said sheathed resistance heating element to a source of electric power said plug-in-type terminal end portions designed to prevent a rotation of said retrofittable stove element in said stove top.

15. The stove of claim 14 wherein said stove comprises at least two different cooking surface sizes.

16. The stove of claim 14 wherein said glass cooking top comprises a transparent portion.

17. The stove of claim 14 wherein said sheathed resistance heating element is substantially insulated from conducting heat to said glass cooking top.

* * * * *